US006254400B1

(12) United States Patent
Yodogawa

(10) Patent No.: US 6,254,400 B1
(45) Date of Patent: Jul. 3, 2001

(54) CONNECTOR STRUCTURE

(75) Inventor: Akihiro Yodogawa, Kanagawa (JP)

(73) Assignee: Berg Technology, Inc., Reno, NV (US)

( * ) Notice: Subject to any disclaimer, the term of this patent is extended or adjusted under 35 U.S.C. 154(b) by 0 days.

(21) Appl. No.: 09/624,472

(22) Filed: Jul. 24, 2000

(30) Foreign Application Priority Data

Jul. 26, 1999 (JP) ..... 11-211321

(51) Int. Cl.[7] ..... H01R 12/00
(52) U.S. Cl. ..... 439/78; 439/353
(58) Field of Search ..... 439/78, 352, 353, 439/354, 357, 358, 370, 901

(56) References Cited

U.S. PATENT DOCUMENTS 4,412,714 * 11/1983 Morningstar et al. ..... 439/352
5,011,425 * 4/1991 Van Zanten et al. ..... 439/353
5,779,495 * 7/1998 Dechelette et al. ..... 439/353

OTHER PUBLICATIONS

Japanese Patent Publication No.: 3–22378 Jan. 1992.

* cited by examiner

*Primary Examiner*—Tulsidas Patel
(74) *Attorney, Agent, or Firm*—Perman & Green, LLP

(57) ABSTRACT

Providing a connector structure is obtained whose structure is simple, and whose release operation for the connector is easy even when the packing density of the connector cover with respect to the substrate is high.

The connector structure according to the present invention is characterized in providing a connector cover 2 installed in a substrate 1, and a connector 3 mounted freely detachably on the connector cover 2, and in particular, the connector 3 is stopped from coming out of the connector cover 3 by the engagement of the latch means 21 and the connector 3 installed on the connector cover 2. At the same time, by moving the rod provided on the connector 3 in the direction of the mounting of the connector 3 of the connector cover 2, the latch means 33 engages the connector, and by moving the rod 33 in the direction of the release of the connector 3 from the connector cover 2, the engagement of the latch 21 and the connector 3 is released.

15 Claims, 3 Drawing Sheets

CONNECTOR STRUCTURE

DETAILED DESCRIPTION OF THE INVENTION

The present invention relates to a connector construction providing a connector cover disposed on a substrate, and a connector mounted freely-detachably on the connector cover.

PRIOR ART

Conventionally, the invention disclosed in Japanese Unexamined Patent Application, First Publication, No. Hei 3-22378, for example, is known as a connector structure. This structure has holes in the side of a connector cover, and provides a rod make of elastic material on the side face of the connector. In addition, when the connector is inserted into an opening formed on the connector cover, by engaging projections formed at the distal end of the rod in the holes, the connector is prevented from coming out of the connector cover. In addition, when the connector is detached from the connector cover, by pressing the proximal end of the rod with a finger on the side surface of the connector and bending the rod into an arc shape towards the outside of the connector, the projections are moved towards the inside of the connector, the engagement between the projections and the holes is released, and the connector is extracted from the concavity.

PROBLEMS TO BE SOLVED BY THE INVENTION

In this connection, in the case of the above-described structure, because the rod must be supported elastically deformable towards the inside and outside of the connector, there is the problem that the support structure of the rod becomes complicated, and the problem that a space for the deformation of the rod is necessary. Furthermore, because the rod is made of an elastic material, there is also the problem that the types of material necessary in the fabrication of the connector increases. In addition, in the case of the above-described structure, when removing the connector from the connector cover, it is necessary to press the rod from the outside, but if the packaging density of the connector cover with respect to the substrate is high, the operation of inserting the finger in the adjacent connector and pressing the rod may be difficult. Furthermore, until the engagement of the projection and the hole is released, it is necessary to continue pushing the rod against the wall face of the connector. Thus, the operation time of the rod is long, and there is the problem that labor power is required in the operation of the rod. In consideration of the above problems, an object of the present invention is to provide a structure that is simple, and in which the operation of removing the connector is simple even when the packing density of the connector cover with respect to the base is high

MEANS FOR SOLVING THE PROBLEM

The present invention is a connector structure providing a connector cover disposed on a substrate and a connector mounted freely-detachably on this connector cover, wherein the connector is extracted from said connector by engaging a latch means provided on the connector cover, and at the same time said latch means engages with said connector by moving a rod mounted on the connector in the mounting direction of the connector to the connector cover, and releasing the engagement between the latch means and the connector by moving the rod in the separation direction from the connector to the connector cover.

In this case, the above latch means is a tongue installed along the attachment and release direction of the connector inside the connector cover and has a hole, and this tongue being is to move towards and away from the connector mounted on the connector cover. At the same time, the connector has a projection that projects towards the hole, and by moving the rod in the mounting direction, the projection engages the hole by the tongue moving towards the connector, and by the rod moving in the separation direction, the tongue is moved to the side that is separated from the connector by a convex part provided on the end of the rod, and the engagement of the projection and the hole is released.

PREFERRED EMBODIMENT

Below, an embodiment of the present invention is explained referring to the figures.

An example of the structure of the connector structure according to the present invention is shown in FIG. 1. The connector structure is generally structured from a connector cover installed on the substrate 1 and a connector 3 mounted freely detachably on the connector cover 2. In addition, reference numeral 4 is a header installed on the base 1 at a position opposite to the connector cover 2, both of which surround the base 1.

The connector cover 2 is a rectangular tube for connecting the pin-shaped terminal 11 installed on the substrate 1 to the connector 3, and mounted on the substrate I so as to surround a specified group of terminals 11. In addition, at the center of the connector cover 2, an opening 2*a* for the insertion of connector 3 is provided passing through the connector cover 2. Furthermore, on one side end surface of the connector cover 2, the tongue (leach means) 21 is formed so as to face the opening 2*a*. The tongue 21 is a member made of metal having a flat shape installed along the direction of the formation (the direction of the attachment and release of the connector 3) of the opening 2*a*, is anchored on the connector cover 2 at the edge on the substrate 1 side, and with its end serving as a fulcrum, can elastically approach and separate in the directions towards and away from the connector cover 2.

The surface of the tongue 21 is roughly parallel with the side edge face of the connector cover 2, and the distal end of the tongue 21 (the edge of the connector 3 insertion side), as shown in FIG. 4, is slightly curved towards the inside (the lower center direction in FIG. 4), and at the same time, the distal end of the tongue is slightly curved towards the outside (the upper center direction in FIG. 4), as shown by reference numeral 21*b* in FIG. 4, in order to simplify insertion of the connector 3. In addition, on the distal end of the tongue 21, a rectangular hole 23 is formed. Furthermore, on the other side edge face of the connector cover 2, a shield terminal 23 for connecting the ground electrode is formed.

The connector 3 generally is structured by a connector block 31 connecting to the terminal 11, a case 32 connecting to the cable 5, and a rod 33 supported on one side end face (the face that serves as the tongue 21 side when installing the connector 3 into the connector cover 2). In addition, the cable 5 is bound to the case 32 by the binding band 6.

The lead line extending from the cable 5 is distributed to the terminals installed in the connector block 31 inside the case 32, and on the distal face of the connector block 31, a plurality of openings (not shown) are formed in order to insert the terminals 11 installed on the substrate I into the above terminals. In addition, from one side end face of the connector block 31 (the side end face that serves as the tongue side when the connector 3 is mounted on the connector cover 2), as shown in FIG. 4, the small projection 36 projects slightly from the hole 22 at a position opposite to the hole 22 formed in the tongue 21. Furthermore, at the side face and the other side end face of the connector block 31, shield terminals 34 and 35 are respectively formed for connecting the ground terminal.

The rod 33 is a rod shaped member extending along the attachment and release direction of the connector 3 with respect to the connector cover 2, and is movably supported along its own lengthwise direction on the case 32. The rod 33 protrudes from the distal end surface of the case 32, and at the same time, has a flat shape extending parallel to the side end face of the connector block 31. In order to avoid interference with the projection 36, as shown in FIG. 4, its distal end is divided into two branches surrounding the projection 36. Furthermore, at the distal end of the rod 33 divided into these two branches, convex parts 37 that protrude in the same direction as the projection 36 are formed.

Here, the amount of projection of the convex parts 37 are made greater than the amount of projection of the projection 36, and the position of the convex parts 37 is set so that when the connector 3 is mounted in the connector cover 2 as described below, and the rod 33 is moved in the direction of the mounting of the connector 3, the concavities 37 are positioned on the substrate 1 side by the curved part 21*a* formed at the distal end of the tongue 21. In addition, in order to increase the sliding characteristics with the tongue 21, the upper face of the concavities 37 is formed in a semicircle, and the distal end face of the projection 36 is made a slanted face.

In the case of the connector structure having the above-described structure, as shown for example in FIG. 2 and FIG. 3, on the same substrate 1, the side face and side end face of adjacent connector covers 2 are mounted so as to be in mutual contact, and respective connectors 3 are mounted freely detachably in these connector covers 2. When mounting the connectors 3 in the connector covers 2, the side end face of the tongue 21 side of the connector cover 2 and the side end face of the rod 33 side of the connector 3 face in the same direction, and the connector block 31 is inserted in the opening 2*a*. Thereby, the terminals 11 are inserted into the connector block 31 via this opening, and the terminals are connected inside the connector block 31.

In addition, along with the insertion of the connector block 31 into the opening 2*a*, in the hole 22 formed on the tongue 21, the projection 36 formed on the connector block 31 is inserted from the inside, and as a result, the hole 22 and the projection 26 are engaged, and the connector is stopped from being removed from the opening 2*a*. This state is shown in FIG. 5. Meanwhile, along with the insertion of the connector block 31 into the opening 2*a*, the distal end of the rod 33 is again inserted into the opening 2*a* on the inside of the tongue 21. Here, by moving the rod 33 in the direction of mounting of the connector 3 (in the direction of the arrow L in FIG. 5), the convex parts 37 are pressed towards the substrate 1 side by the curved part 21*a* of the tongue 21, and the interference between the convex parts 37 and the tongue 21 is prevented.

When the connector 3 is removed from the connector cover 2, the rod 33 is moved in the detachment direction (the direction of the arrow R in FIG. 6) of the connector 3. Thereby, the convex parts 37 overlap the curved part 21*a* from the inside, the tongue 21 moves outward from the convex parts 37 (the side separated from the connector 33), the engagement of the projection 36 and the hole 22 are released, and the connector block 31 can be extracted from the opening 2*a*. This state is shown in FIG. 6. In addition, in this state, by moving the connector 3 in the direction of the arrow R, the connector block 31 is extracted from the connector block 31, and the connector 3 is released form the connector cover 2.

In the connector structure having the above-described structure, the rod 33 can by movably supported along the attachment and release direction of the connector on the case 32, and thus the support structure of the rod 33 is simplified, and the installment space of the rod 33 can be made small. In addition, there is no necessity to use a special material, such as elastic material, for the rod 33. Furthermore, when attaching and releasing the connector 3 from the contact cover 2, the rod 33 can be moved along the direction of attachment and release of the connector 3, and thereby, as shown for example in FIG. 2 and FIG. 3, even when the packing density of the connector cover 2 is high with respect to the substrate, the operation of the rod 33 and the attachment and release of the connector 3 are not obstructed. In addition, the operation of the rod 33 need only take place during the beginning of the attachment and release of the connector 3, and thus, the operation time of the rod 33 can be reduced. Due to the amount of projection of the rod 33 from the base edge face of the case 32, there is the effect that visual confirmation of whether or not the connector 3 is fastened becomes easy.

EFFECT OF THE INVENTION

As explained above, according to the above-described invention, a connector structure is obtained whose structure is simple, and whose release operation for the connector is easy even when the packing density of the connector cover with respect to the substrate is high.

EXPLANATION OF THE REFERENCE SYMBOLS

Figure 1:
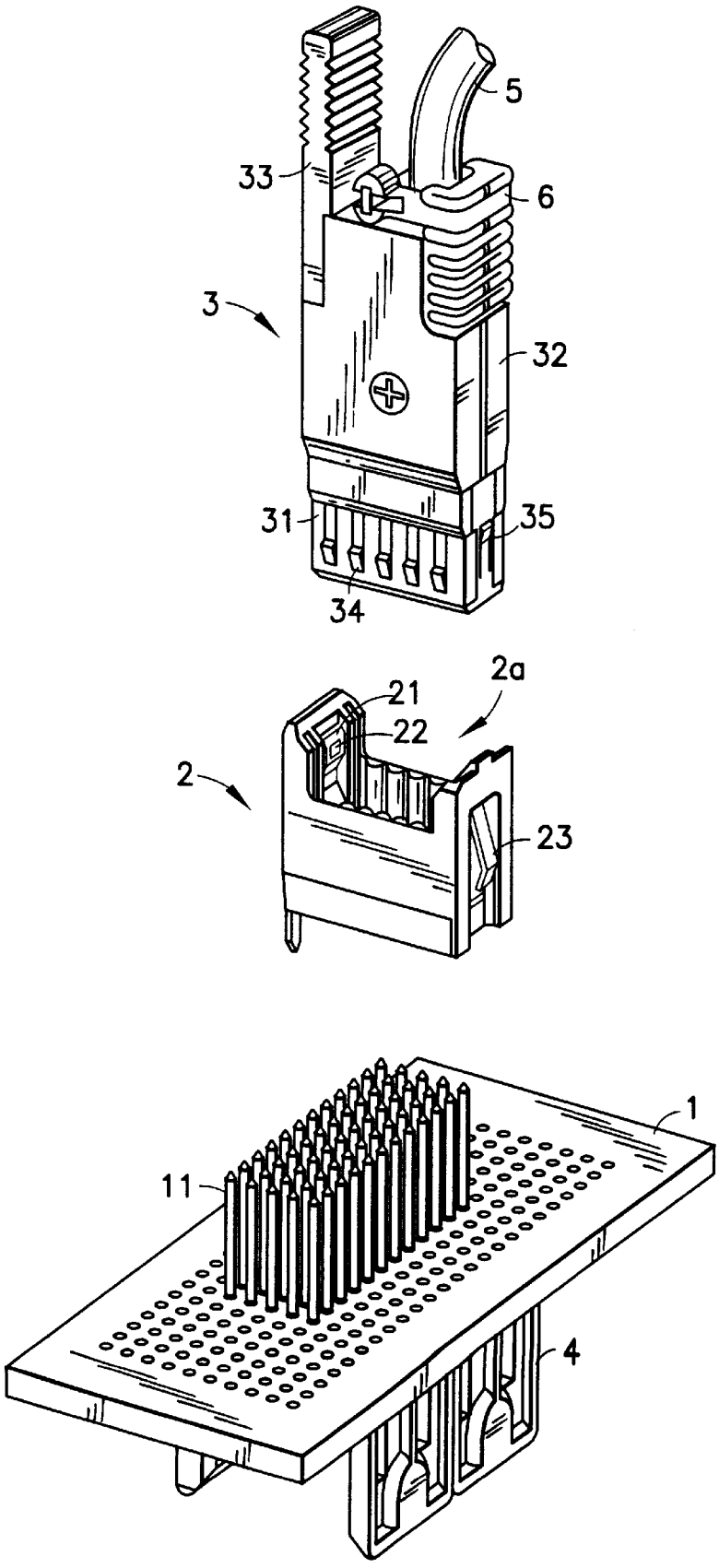
FIG. 1 is a perspective drawing from above showing an example of the structure of a connector structure according to the present invention.
Figure 2:
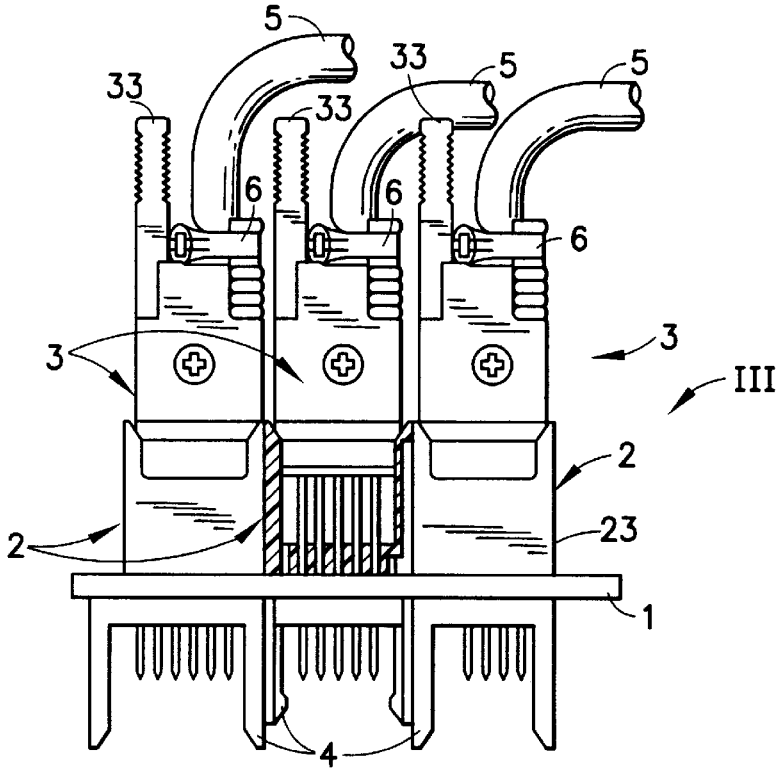
FIG. 2 is a partial cross-sectional drawing along the arrow II in FIG. 3 showing an example of the set-up of the connector structure according to the present invention.
Figure 3:
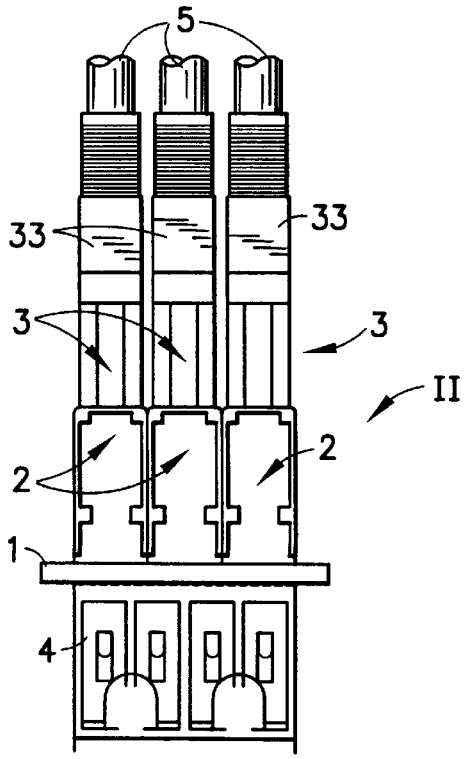
FIG. 3 is a side face drawing along the arrow III in FIG. 2 showing an example of the set-up of the connector structure according to the present invention.
Figure 4:
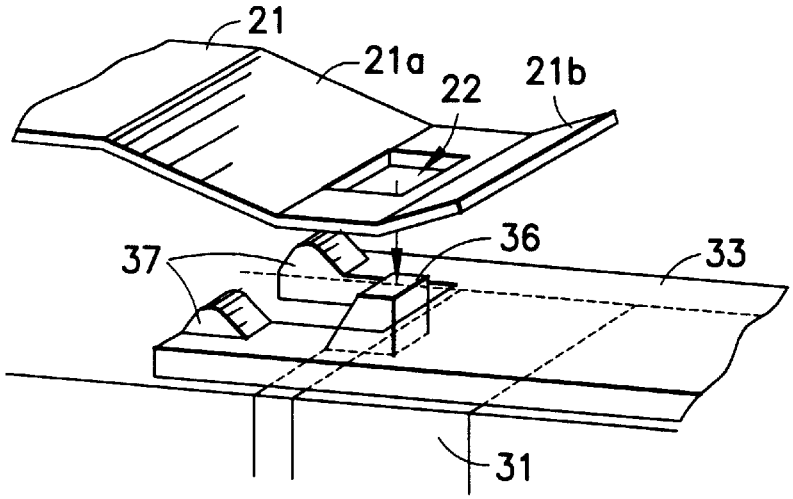
FIG. 4 is a drawing showing an example of the shape of the tongue the distal end of the rod in the connector structure according to the present invention.
Figure 5:
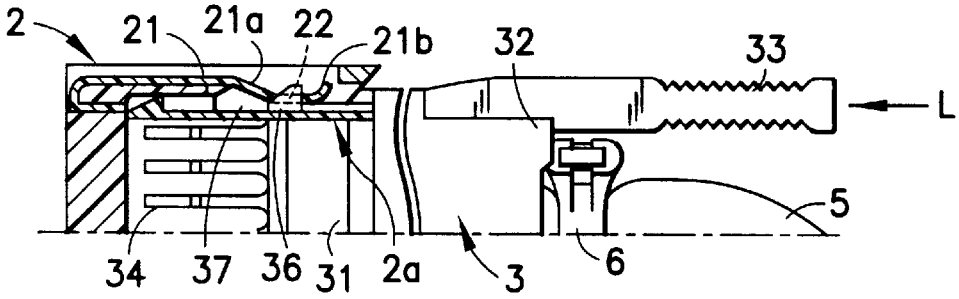
FIG. 5 is a partial cross-sectional drawing showing the engagement state of the tongue and the rod in the connector structure according to the present invention.
Figure 6:
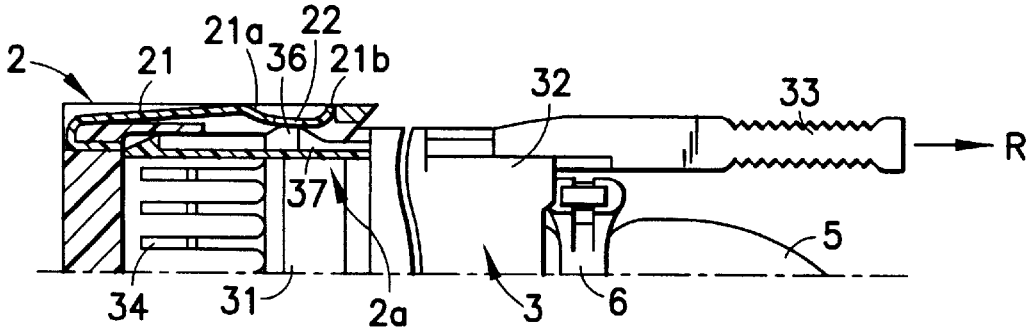
FIG. 6 is a partial cross-sectional drawing showing the state when the engagement of the tongue and the rod is released in the connector structure according to the present invention.

1 substrate
2 connector cover
3 connector

21 tongue

22 hole

33 rod

36 projection

27 convex parts

What is claimed is:

1. An electrical structure comprising:

a connector cover comprising a movable latch, the connector cover being adapted to be disposed on a substrate; and an electrical connector adapted to be removably connected to the connector cover, the electrical connector comprising a movable rod which is movable along the electrical connector in a mounting direction of the electrical connector to the connector cover and a separation direction of the electrical connector from the connector cover, the electrical connector being adapted to engage the latch when the electrical connector is connected to the connector cover in the mounting direction, wherein, when the electrical connector is connected to the connector cover, the rod is movable on the electrical connector in the separation direction to move the latch and release latching engagement between the latch and the electrical connector such that the electrical connector can be removed from the connector cover in the separation direction.

2. An electrical connector structure as in claim 1 wherein the latch comprises a tongue which is mounted along the mounting direction, wherein the tongue comprises a hole, wherein the tongue is movable towards and away from the electrical connector, wherein the electrical connector comprises a projection with the hole of the tongue moving onto and off of the projection when the tongue is moved towards and away from the electrical connector, wherein when the rod is moved in the mounting direction the hole of the tongue is moved onto the projection and when the rod is moved in the separation direction the tongue is moved by convex parts on the rod to move the hole off of the projection and thereby release latching engagement between the tongue and the projection.

3. An electrical connector structure as in claim 1 wherein the movable latch comprises a cantilevered tongue with a latching hole.

4. An electrical connector structure as in claim 3 wherein the tongue comprises curved parts in front of and behind the latching hole.

5. An electrical connector structure as in claim 3 wherein the tongue comprises a home latching position inside a connector receiving area of the cover and is outwardly deflectable to a delatching position.

6. An electrical connector structure as in claim 1 wherein the connector cover is adapted to receive terminals of a header therein on an opposite side of the substrate from the header.

7. An electrical connector structure as in claim 6 wherein the connector cover is adapted to be fixedly and stationarily placed directly against another connector cover on the substrate.

8. An electrical connector structure as in claim 1 wherein the electrical connector comprises a connector block having openings for removably receiving terminals and a connector case fixedly connected to the connector block and adapted to fixedly connect to a cable.

9. An electrical connector structure as in claim 8 wherein connector block comprises an outwardly extending latching projection on a side of the connector block.

10. An electrical connector structure as in claim 9 wherein the rod comprises at least one protruding part movable into and out of alignment with the latching projection as the rod is moved.

11. An electrical connector structure as in claim 10 wherein the rod comprises branches on opposite sides of the latching projection.

12. An electrical component assembly comprising:

a substrate;

an electrical connector header connected to a first side of the substrate and having terminals extending through the substrate to a second opposite side of the substrate;

a connector cover connected to the second side of the substrate and having at least some of the terminals therein, the connector cover having a movable latch; and an electrical connector adapted to be removably connected to the connector cover and make electrical contact with the terminals on the second side of the substrate, the electrical connector having a movable rod adapted to slide in a mounting direction and a separation direction of the connector with the cover and adapted to move the latch in an outward direction to delatch the latch from the electrical connector.

13. An assembly as in claim 12 wherein the movable latch comprises a cantilevered deflectable tongue extending into an electrical connector receiving area of the cover in a home position.

14. An assembly as in claim 12 wherein the electrical connector comprises a latching projection and wherein the rod comprises branches slidably located on opposite sides of the latching projection, at least one of the branches having a protruding part which can be moved into and out of alignment with the latching projection as the rod is moved.

15. An electrical connector assembly comprising:

a cable;

a connector case fixedly connected to the cable;

a connector block fixedly connected to the connector case, the connector block comprising openings for removably receiving terminals and a stationary latching projection at a side of the connector block; and a rod slidably connected to the side of the connector block and a side of the connector case, the rod comprising branches on opposite sides of the latching projection, each branch having a protruding part which protrude in a same direction as the latching projection, wherein the rod is slidable along the connector block and the connector case to move the protruding parts into and out of alignment with the latching projection.

* * * * *